United States Patent [19]

Teschner et al.

[11] 4,190,498

[45] Feb. 26, 1980

[54] SYSTEM TO ACQUIRE AND MONITOR OPERATING MACHINERY POSITIONS FOR HORIZONTAL COKE OVEN BATTERIES

[75] Inventors: Wolfgang Teschner, Ratingen-Hösel; Dieter Bierbaum, Herne, both of Fed. Rep. of Germany

[73] Assignee: Firma Carl Still, Fed. Rep. of Germany

[21] Appl. No.: 869,444

[22] Filed: Jan. 16, 1978

[30] Foreign Application Priority Data

Jan. 19, 1977 [DE] Fed. Rep. of Germany ..... 2701930

[51] Int. Cl.[2] ..... C10B 33/10

[52] U.S. Cl. ..... 202/262; 318/600; 414/214

[58] Field of Search ..... 201/1; 202/262, 239, 202/270; 318/600; 214/23

[56] References Cited

U.S. PATENT DOCUMENTS

| | | | |
|---|---|---|---|
| 3,427,518 | 2/1969 | Cloup | 318/600 |
| 3,897,311 | 7/1975 | Krenke | 201/1 X |
| 4,020,406 | 4/1977 | Tokuno et al. | 318/600 |
| 4,067,461 | 1/1978 | Sperduti | 202/262 X |
| 4,072,885 | 2/1978 | Emark, Jr. | 202/262 X |

FOREIGN PATENT DOCUMENTS

| | | | |
|---|---|---|---|
| 1571640 | 2/1971 | Fed. Rep. of Germany | 202/262 |
| 2203524 | 8/1973 | Fed. Rep. of Germany | 202/262 |
| 46-7377 | 2/1971 | Japan | 201/1 |
| 333180 | 7/1972 | U.S.S.R. | 201/1 |

*Primary Examiner*—Arnold Turk

*Attorney, Agent, or Firm*—McGlew and Tuttle

[57] ABSTRACT

In a horizontal coke oven battery with at least one coke receiving device movable along one longitudinal side of the battery and at least one coke driving device movable along an opposite longitudinal side of the battery, an apparatus for determining the relative position of the coke receiving device with respect to the coke driving device and for activating the coke driving device when its position corresponds with that of the coke receiving device, comprising, a first wheel mounted on the coke receiving device for rotation with the movement of the coke receiving device, a first angle encoder connected to the first wheel for producing a first signal corresponding to the location of the first wheel and the position of the coke receiving device along the coke oven, and an input storage in the form of a magnetic disc connected to the first angle encoder for recording and storing the signal. A second wheel is mounted on the coke driving device for rotation with the movement of the coke driving device and a second angle encoder is connected thereto for producing a second signal which corresponds to the rotation of the second wheel and the position of the coke driving device along the coke oven. A comparator is connected to the second signal encoder for receiving the second signal and a data link is provided between the comparator and the input storage of the coke receiving device so that the first signal from the coke receiving device can be impressed on the comparator. An activator is connected to the comparator for activating the coke driving device when the first signal corresponds to the second signal indicating a corresponding positional relationship between the coke receiving device and the coke driving device.

10 Claims, 2 Drawing Figures

SYSTEM TO ACQUIRE AND MONITOR OPERATING MACHINERY POSITIONS FOR HORIZONTAL COKE OVEN BATTERIES

FIELD AND BACKGROUND OF THE INVENTION

This invention relates in general to horizontal coke oven batteries and, in particular, to a new and useful method and apparatus for acquiring and monitoring the operating machinery positions for horizontal coke oven batteries in their operating range by using electronic and mechanical control and testing setups, which are arranged on coke oven operating machines or are connected thereto. These record, control and monitor the mutual positions of coke oven operating machines and act upon drives for executing their functions. They also prepare the next required operating position.

DESCRIPTION OF THE PRIOR ART

According to the invention, the coke oven operating machinery comprises a feeding device and/or lorry, a coke ram machine, a coke guide car, and a device which picks up the red hot coke from the guide car and delivers it to a quenching device.

With a known switching arrangement for ascertaining the position of several coke oven operating machines operable on both faces of a coke oven battery in front of the same coke oven battery oven, each coke oven operating machine is provided with a device for establishing its local position, the local data are compared in a control device, and the command for the pressure drive of the coke ram machine is released only if a message is present on the correct position of the oven doors, see German Offenlegungsschrift 1,571,640.

The local data can be given through counters, driven by a running axle or an additional bogie wheel or mechanical cam, e.g., an electronic pulse generator, through a verifiable frequency or pulse time telegram, or by transmitting via contact lines or by radio to the control device, or via contact lines which serve the electrical power supply to the coke oven operating machines.

The local position of each coke oven operating machine within an oven area can also be acquired by an additional electrical or mechanical element, whereby, the release of the interlocking relay for the pressure drive of the coke ram machine is an additional function of the element's actuation. This additional electrical element can also be arranged on the coke oven operating machine.

With this switching arrangement, a specific association is provided for each oven machine, which is effective via special directional counters for each machine, whereby, individual incremental operating pickups and oven machine receiver units are switched "in parallel" and carried via a transmission path common to all oven chambers. Because of serial input pulses (incremental processes) and post-staged directional counters, the system does not exclude the presence of errors produced by interference peaks, power supply glitches, etc. A correction of directional counter states is not provided to counter this error. For the above reasons, the installation is prone to breakdowns and is workable to insure a safe and precise positional acquisition only by adding expensive installations.

SUMMARY OF THE INVENTION

The object of the present invention is to obtain a system of the above described type, which while being comparatively inexpensive, is resistant to breakdowns and safely and exactly acquires the positions of individual coking plant machines and positions them accordingly.

In accordance with the invention, the coking plant machines are provided with bogie wheel driven angle encoders which assign an absolute numerical value to each machine position. These numerical values are stored on code discs as code patterns, and the angle encoder sends out a coded machine position signal, which is transmitted via a data link to a receiver station, which compares the positions and acts on the machine drives. If positions agree, it releases the current supply to the drives and automatically switches them in.

The great advantage and technological progress which can be attained with the system according to the invention is that the positional messages cannot be altered by power supply breakdowns. In case such breakdowns occur, the original code is maintained. Even interference pulses have no effect on code and/or positional messages. In addition, any absolute numerical values to be fixed can be called off at any time. Single stage or multistage angle encoder designs can be used for the system according to the invention. Data transmissions can be controlled by radio or by inductance.

Accordingly, an object of the invention is to provide an apparatus for detecting and storing the relative position of a coke receiving device with respect to a coke driving device and for activating the coke driving device when the relative positions correspond along the lateral sides of a horizontal coke oven comprising, a first wheel mounted on the coke receiving device for rotation with the movement of the coke receiving device along the coke oven, a first angle encoder connected to the first wheel for producing a first signal corresponding to the position of the coke receiving device, and an input storage for storing the first signal and relaying it to the coke driving device, and including a second wheel mounted on the coke driving device for rotation with the movement of the coke driving device along the coke oven, a second angle encoder connected to the second wheel for producing a second signal corresponding to the position of the coke driving device, a comparator connected to the angle encoder for receiving the second signal and a data link connected to the comparator for supplying the comparator with the first signal, whereby, the comparator compares the first signal with the second signal and indicates the correlation between the positions of the coke receiving device and the coke driving device, and further including an actuator connected to the comparator for actuating the coke driving device when the comparator indicates the correlation between the coke receiving device and the coke driving device.

A further object of the invention is to provide an apparatus for detecting the relative positions of the coke receiving device in respect to the coke driving device, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

GENERAL DESCRIPTION OF THE PREFERRED EMBODIMENT

Figure 1:
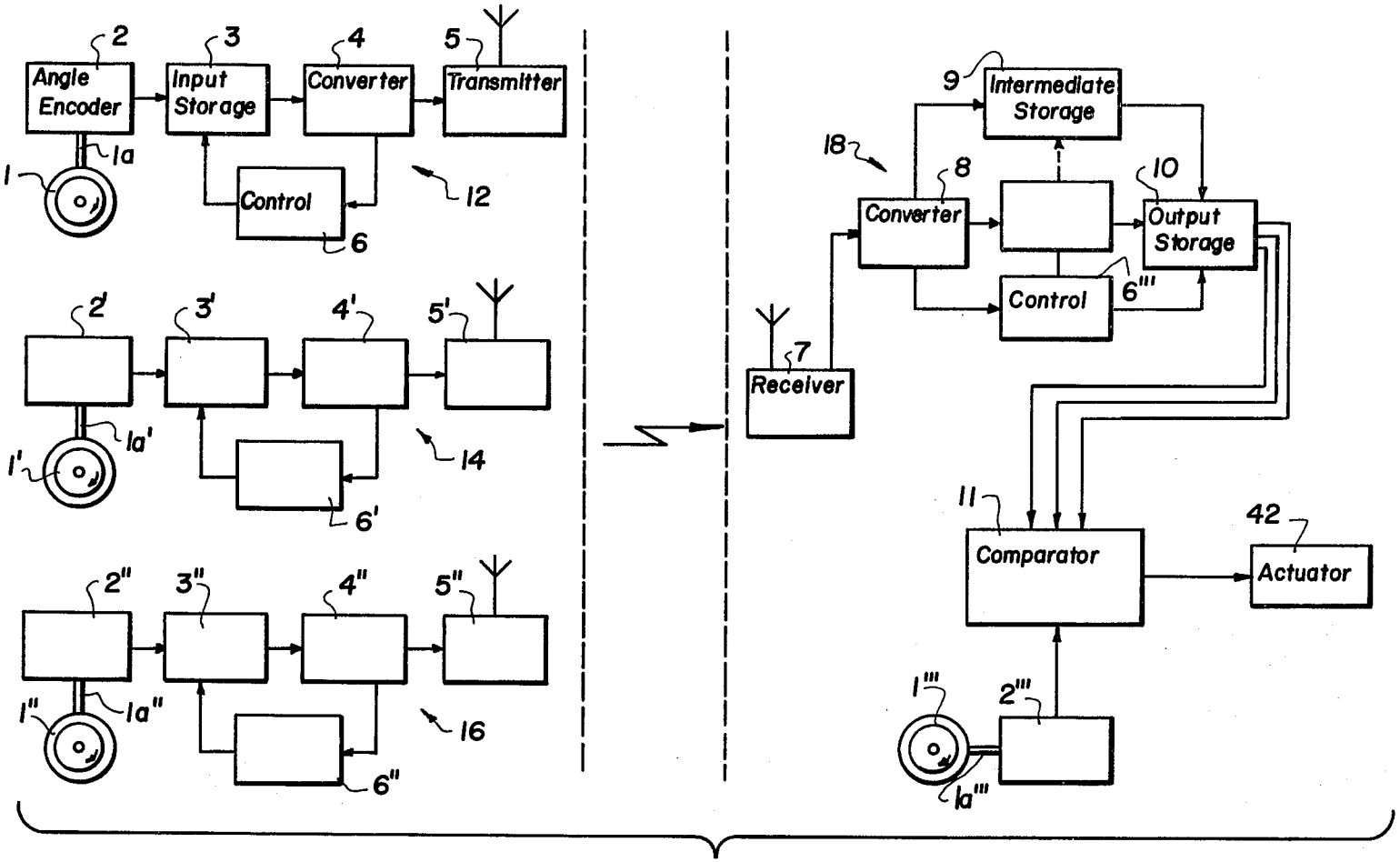
FIG. 1 is a schematic representation of the apparatus, according to the invention, showing a plurality of coke receiving devices on the one side of a horizontal coke oven and a coke ram device on the opposite side.

Referring now to FIG. 1, a multistage angle encoder and a radio-controlled data link device is used. In an identical way on the coke side, the charging car 12, the coke cake guide car 14 and the quenching car locomotive 16 are equipped with angle encoders. These each may be termed first coke devices for this application. In the charging car, 1 designates a free turning bogie wheel, which is run along on a rail. Its rotation is transmitted to angle encoder 2 via shaft 1*a*. BCD-code (binary-coded-decimal) numberical values corresponding to machine positions to be fixed are entered into a durable input storage 3. Input storage 3 is termed "durable" in that it comprises a permanent storage of the first coke device position that can be updated when the position changes. Input storage may thus comprise a magnetic disc for this purpose. The data to be fixed at its output in parallel are subdivided into data blocks and serially converted in converter 4 by control mechanism 6. The serial data blocks are then broadcast by transmitter 5 and picked up by receiver 7, which is arranged on the machine side of the oven, on the ram machine 18. The ram may be replaced by other slidable machines on the machine side which each is termed a second coke device for this application.

The data blocks are again parallel converted in converter 8 and stored in intermediate storage 9. A transmission takes place in an output storage 10 following the last data block. The message to be fixed at the receiver installation output contains the BCD-coded machine positions on the coke side, and these are compared in a comparator 11 with the BCD-coded ram machine positional message. Upon an agreement, the pressure drive of the ram machine is released to activate the ram. Like elements are designated with like numerals, but with a prime for the guide car, a double prime for the locomotive and a triple prime for the ram.

Figure 2:
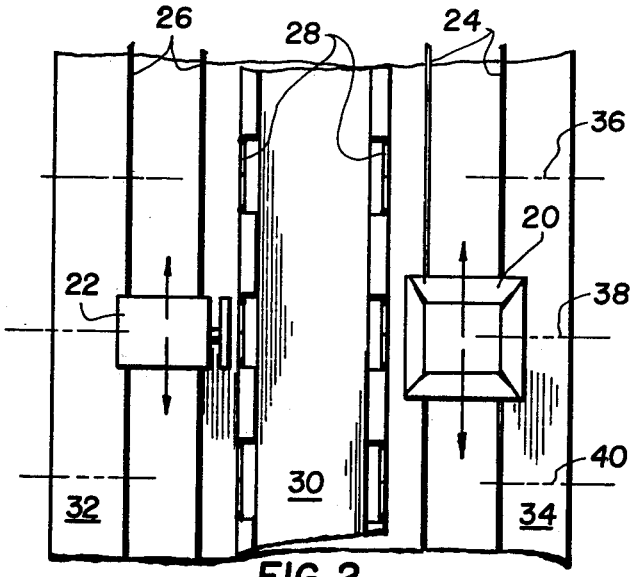
FIG. 2 is a schematic representation of a plan view of the apparatus of the invention.

FIG. 2 shows a horizontal coke oven battery 30 with a plurality of coke oven with doors 28 disposed along either longitudinal side thereof. A coke receiving device 20 is mounted for movement along one longitudinal side 34 of the coke oven 30, on rails 24.

In one embodiment of the invention, the bogie wheel 1 of FIG. 1 rides along rails 24 to produce the first signal corresponding to positions of the coke receiving device 20. On an opposite longitudinal side 32 of the coke oven battery 30, a coke driving device in the form of a coke ram 22 is mounted for movement along rails 26. Bogie wheel 1''' of the ram rides along rails 26 to indicate the position of the ram 22. When the comparator 11 indicates that both the ram 22 and coke receiving device 20 are at a selected position exemplified by 36, 38 and 40 of FIG. 2, the actuator 42 of the ram 22 is energized, forcing the ram through the coke oven doors 28 to deposit coke on the coke receiving car 20.

While a specific embodiment of the invention has been shown and described in detail to illustrate the application of the principles of the invention, it will be understood that the invention may be embodied otherwise without departing from such principles.

What is claimed is:

1. A system for detecting the relative position of a first coke device on one side of a horizontal coke oven battery with respect to the position of a second coke device on an opposite side of the horizontal coke oven battery and for activating the second coke device when the relative positions correspond along the coke oven battery, comprising a first wheel mounted on the first coke device for rotation with the movement of the first coke device along the coke oven battery, a first angle encoder connected to said first wheel for producing a first numerical value signal corresponding to the rotation of said first wheel and to the position of the first coke device along the coke oven battery, an input storage means which includes a code disc connected to said first angle encoder for recording and durably storing said first numerical value signal as a code pattern on said code disc, a second wheel mounted on the second coke device for rotation with the movement of the second coke device along the coke oven battery, a second angle encoder connected to said second wheel for producing a second signal corresponding to the rotation of said second wheel and the position of the second coke device along the coke oven battery, a comparator connected to said second angle encoder for receiving said second signal, a data link connected between said input storage means and said comparator for relaying said first numerical value signal to said comparator whereby said comparator compares said first numerical value signal with said second signal, and an actuator means connected to said comparator for actuating the second coke device when said first and second signals correspond to indicate the correspondence of positions of the first and second coke devices along the coke oven battery.

2. A system, as claimed in claim 1, wherein the rotation of said first wheel is transmitted to a multistage angle encoder.

3. A system, as claimed in claim 1, in which the data are transmitted in a binary code.

4. A system, as claimed in claim 1, wherein said data link comprises a transmitter connected to said input storage means and a receiver connected to said comparator for transmitting said first numerical value signal by radio.

5. A system, as claimed in claim 1, further including a serial converter connected to said input storage means for serially converting said first numerical value signal into serial data blocks, a transmitter connected to said serial converter for transmitting said serial data blocks in the form of radio waves, a receiver for receiving said transmitted serial data blocks, a second serial converter connected to said receiver for converting said serial data blocks into said second signal, an intermediate storage connected to said second serial converter for storing said second signal, an output storage connected to said intermediate storage for durably storing said second signal, and said comparator connected to said output storage.

6. A system, as claimed in claim 1, wherein said data link comprises means connected between said input storage means and said comparator for transmitting said first numerical value by inductance.

7. In a horizontal coke oven battery with at least one coke receiving device movable along one longitudinal side thereof and at least one coke driving device movable along an opposite longitudinal side thereof, an apparatus for detecting the relative position of the coke receiving device with respect to the coke driving device and for activating the coke driving device when the relative positions correspond along the coke oven, comprising a first wheel mounted on the coke receiving device for rotation with the movement of the coke receiving device along the coke oven, a first angle encoder connected to said first wheel for producing a first signal corresponding to the rotation of said first wheel and to the position of the coke receiving device along the coke oven, an input storage means connected to said first angle encoder for recording and durably storing said first signal, a second wheel mounted on the coke driving device for rotation with the movement of the coke driving device along the coke oven, a second angle encoder connected to said second wheel for producing a second signal corresponding to the rotation of said second wheel and the position of the coke driving device along the coke oven, a comparator connected to said second angle encoder for receiving said second signal, a data link connected between said input storage means and said comparator for relaying said first signal to said comparator whereby said comparator compares said first signal with said second signal, and an actuator means connected to said comparator for actuating the coke driving device when said first and second signals correspond to indicate the correspondence of the positions of the coke receiving and driving devices along the coke oven.

8. An apparatus, as claimed in claim 7, wherein said data link comprises a radio transmitter connected to said input storage means and a receiver connected to said comparator.

9. An apparatus, as claimed in claim 7, wherein said input storage means includes a magnetic disc for recording said first signal.

10. An apparatus, as claimed in claim 7, wherein said driving device is a coke ram.

* * * * *